US009731938B2

(12) United States Patent
Wesson et al.

(10) Patent No.: US 9,731,938 B2
(45) Date of Patent: Aug. 15, 2017

(54) COATED ROPE OR BELT FOR ELEVATOR SYSTEMS

(75) Inventors: John P. Wesson, Vernon, CT (US); Huan Zhang, Glastonbury, CT (US); Gopal R. Krishnan, Westhersfield, CT (US); Timothy D. Devalve, Manchester, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 176 days.

(21) Appl. No.: 14/002,015

(22) PCT Filed: Apr. 14, 2011

(86) PCT No.: PCT/US2011/032505

§ 371 (c)(1),
(2), (4) Date: Aug. 28, 2013

(87) PCT Pub. No.: WO2012/141710

PCT Pub. Date: Oct. 18, 2012

(65) Prior Publication Data

US 2014/0027211 A1 Jan. 30, 2014

(51) Int. Cl.

*B66B 7/06* (2006.01)
*D07B 1/06* (2006.01)
*D07B 1/22* (2006.01)

(52) U.S. Cl.

CPC ..... *B66B 7/062* (2013.01); *B66B 7/06* (2013.01); *D07B 1/0693* (2013.01);
(Continued)

(58) Field of Classification Search

CPC ..... B66B 7/06; B66B 7/062; D07B 1/062; D07B 1/0633; D07B 1/0653;
(Continued)

(56) References Cited

U.S. PATENT DOCUMENTS 1,312,872 A * 8/1919 Rettinger ..... 245/1.5
2,894,366 A * 7/1959 Leckie ..... A01K 73/053 114/241

(Continued)

FOREIGN PATENT DOCUMENTS

EP 0 250 010 A1 12/1987
EP 0357883 B2 9/1998

(Continued)

OTHER PUBLICATIONS

European Search Report Application No. EP 11 86 3702 reported on Jan. 9, 2015.

(Continued)

*Primary Examiner* — Minh Truong
(74) *Attorney, Agent, or Firm* — Cantor Colburn LLP

(57) ABSTRACT

Elevator coated ropes or belts are disclosed. The coated rope or belt may include at least one cord and a jacket retaining the at least one cord. The cord may include a plurality of filaments. The filaments are free of second-order helical structure. In a first embodiment, the filaments includes at least one inner filament and a plurality of outer filaments surrounding the at least one inner filament. The outer filaments are bunched together by forming a first-order helical structure through the length of the cord. In a second general embodiment, the filaments are free of both first- and second-order helical structures. The filaments are bunched together by a restraining loop or adhesive at one or more locations along the length of the cord. Methods of making the tension cord are also disclosed.

7 Claims, 9 Drawing Sheets

(52) U.S. Cl.
CPC ..... *D07B 1/0626* (2013.01); *D07B 1/0633* (2013.01); *D07B 1/22* (2013.01); *D07B 2201/2023* (2013.01); *D07B 2201/2028* (2013.01); *D07B 2201/2033* (2013.01); *D07B 2201/2044* (2013.01); *D07B 2201/2046* (2013.01); *D07B 2201/2055* (2013.01); *D07B 2201/2056* (2013.01); *D07B 2201/2068* (2013.01); *D07B 2201/2097* (2013.01); *D07B 2501/2007* (2013.01); *Y10T 156/10* (2015.01)

(58) Field of Classification Search
CPC .... D07B 1/0666; D07B 1/068; D07B 1/0693; D07B 1/10; D07B 2201/1092; D07B 2201/2033; D07B 2201/206
See application file for complete search history.

(56) References Cited

U.S. PATENT DOCUMENTS

| | | | | |
|---|---|---|---|---|
| 3,114,987 | A * | 12/1963 | Harris | D07B 1/10 52/223.14 |
| 3,271,219 | A | 9/1966 | Nickerson et al. | |
| 3,273,978 | A | 9/1966 | Paul | |
| 3,482,034 | A * | 12/1969 | Rhoades | A01K 73/02 114/244 |
| 3,726,078 | A * | 4/1973 | Nakamura | B29D 29/00 152/526 |
| 3,861,442 | A * | 1/1975 | Bertrand | B60C 15/04 152/540 |
| 4,523,425 | A * | 6/1985 | Schild | D07B 1/0613 57/210 |
| 4,756,970 | A | 7/1988 | Brandyberry et al. | |
| 4,807,680 | A | 2/1989 | Weidenhaupt et al. | |
| 5,566,786 | A * | 10/1996 | De Angelis | B66B 7/06 187/266 |
| 5,651,245 | A | 7/1997 | Damien | |
| 5,797,254 | A | 8/1998 | Walton | |
| 5,881,843 | A * | 3/1999 | O'Donnell | B66B 7/06 187/254 |
| 6,076,344 | A * | 6/2000 | Doujak | D07B 1/0646 57/10 |
| 6,289,742 | B1 * | 9/2001 | De Angelis | B66B 7/06 73/158 |
| 6,334,293 | B1 * | 1/2002 | Poethke | B60C 9/0007 57/210 |
| 6,412,264 | B1 * | 7/2002 | De Josez | B66B 7/06 57/217 |
| 6,563,054 | B1 | 5/2003 | Damien et al. | |
| 6,672,046 | B1 | 1/2004 | Prewo et al. | |
| 6,703,126 | B1 | 3/2004 | Miyazaki et al. | |
| 6,811,877 | B2 * | 11/2004 | Haislet | D02G 3/48 152/451 |
| 7,036,298 | B2 | 5/2006 | Honda | |
| 7,137,483 | B2 | 11/2006 | Kato et al. | |
| 7,191,585 | B2 | 3/2007 | Vanderbeken et al. | |
| 7,770,328 | B2 | 8/2010 | Vanderbeken et al. | |
| 2003/0051788 | A1 * | 3/2003 | Besson | B60C 9/0007 152/451 |
| 2003/0145936 | A1 * | 8/2003 | Hrycyk | B29D 30/48 156/136 |
| 2004/0016602 | A1 | 1/2004 | Aulanko et al. | |
| 2004/0231312 | A1 | 11/2004 | Honda | |
| 2006/0086415 | A1 | 4/2006 | Eichhorn | |
| 2008/0067010 | A1 | 3/2008 | Ach | |
| 2008/0296546 | A1 * | 12/2008 | Bergendahl | D07B 1/0673 256/13.1 |
| 2010/0071340 | A1 | 3/2010 | Ridge et al. | |

FOREIGN PATENT DOCUMENTS

| | | | |
|---|---|---|---|
| EP | 0864688 | A1 | 9/1998 |
| EP | 1329413 | A1 | 7/2003 |
| EP | 1334943 | A1 | 8/2003 |
| EP | 1371597 | A1 | 12/2003 |
| EP | 1431450 | A2 | 6/2004 |
| EP | 1 426 482 | A1 | 9/2004 |
| EP | 1 498 542 | A1 | 1/2005 |
| EP | 1 561 719 | A1 | 8/2005 |
| EP | 1886961 | B1 | 12/2009 |
| GB | 1418554 | A | 12/1975 |
| GB | 2 252 774 | A | 8/1992 |
| JP | H08 170286 | A | 7/1996 |
| JP | 199600020356 | | 2/1998 |
| JP | H1046746 | A | 2/1998 |
| KR | 20040068177 | A | 7/2004 |
| KR | 100693082 | B1 | 3/2007 |
| WO | WO 01/14630 | A1 | 3/2001 |
| WO | WO-02/16248 | A1 | 2/2002 |
| WO | WO-02/064480 | A1 | 8/2002 |
| WO | WO-2005/068696 | A1 | 7/2005 |
| WO | WO 2007/062803 | A1 | 6/2007 |
| WO | WO 2009/026730 | A1 | 3/2009 |

OTHER PUBLICATIONS

Molkow M: "Wire Ropes and new Suspension Means Design, Use, Safety, Handling and Care, Discard Criteria" Lift Report, VFZ Verlag, Dortmunt, De, vol. 27, No. 5, Sep. 1, 2001 (Sep. 1, 2001), pp. 14, 16, 18-20, XP001092527, ISSN: 0341-3721 p. 20, left-hand column-middle column.

International Search Report and Written Opinion for related International Application No. PCT/US11/32505; report dated Jan. 18, 2012.

Third Chinese Office Action and Search Report for application 201180070027.2, mailed Apr. 1, 2016, 15 pages.

Chang, Karl K. "Aramid Fibers", E.I. Dupont de Nemours & Company, Inc., ASM Handbook vol. 21, Compo XP055210836, 2001, pp. 41-45.

European Office Action for application EP 11863702.4 dated Sep. 30, 2016, 9 pages.

* cited by examiner

COATED ROPE OR BELT FOR ELEVATOR SYSTEMS

CROSS-REFERENCE TO RELATED APPLICATIONS

This application is a U.S. national stage filing under 35 USC §371 of International Patent Application No. PCT/US11/32505, filed on Apr. 14, 2011.

BACKGROUND

Technical Field

The present disclosure is directed to coated ropes or belts such as those used in elevator systems, more particularly to coated ropes or belts such as those used to suspend and/or drive an elevator car and/or counterweight of an elevator system, and even more particularly to the load-bearing cords used in such coated ropes or belts.

Description of the Related Art

Traction elevator systems are widely used. In general, a traction elevator system can include a car, a counterweight, one or more coated ropes or belts interconnecting the car and counterweight, a traction sheave to move the coated rope or belt, and a motor-driven machine to rotate the traction sheave. The sheave is formed from cast iron. In some elevators, the coated rope or belt is a rope formed from twisted steel wires. In other elevators, the coated rope or belt is an elevator coated rope or belt with the twisted wires within an outer jacket.

In general, conventional elevator coated ropes or belts can include a plurality of steel wires of specific number, size and geometry for purposes of strength, proper coated rope or belt diameter, cost of production, and/or durability. For example, for a given steel strength, the total cross-sectional area of the steel wires used in the coated rope or belt generally determines the strength of the coated rope or belt. For coated ropes or belts of the same strength, i.e. same total cross sectional area of the steel wires, using more wires (of relatively smaller diameters) would generally increase the cost of production of the coated rope or belt but provide longer fatigue life. On the other hand, using fewer wires (of relatively larger diameters) would generally lower the cost of production of the coated rope or belt but shorten fatigue life, thereby affecting the durability of the coated rope or belt.

In some elevator systems, the coated rope or belt can include several strands, each including filaments, twisted together to form a second-order helical structure with increased strength. Alternatively, the coated rope or belt could include a layer of filaments twisted around a center strand of twisted filaments, such as in a (1+6+12) arrangement. However, those approaches involve multiple winding (twisting) steps, which may require capital hardware and increase production cost and time.

Moreover, conventional cord configurations discussed above include helical filaments with non-uniform spatial orientations, such as different pitch, direction, and/or helical axis. Such non-uniformity may adversely affect the durability of the cord. Moreover, cord of conventional configurations may also generate noise due to such traction tension.

Tension cords are also used in other technology fields. For example, tension cords are used in automobiles to raise and lower windows. However, those cords are formed with filaments that are both micro-sized and made from synthetic resin. Due to the significant difference in dimension, material, and application, filament arrangement in those tension cords are generally considered unsuitable for use in traction elevators

SUMMARY OF THE DISCLOSURE

In one aspect of the present invention, a coated rope or belt for suspending and/or driving an elevator car includes at least one cord and a jacket retaining the at least one cord. The cord includes a plurality of filaments. The filaments are free of second-order helical structure.

Alternatively in this or other aspects of the invention, the filaments comprise at least one inner filament and a plurality of outer filaments surrounding the at least one inner filament, the outer filaments forming a first-order helical structure.

Alternatively in this or other aspects of the invention, the outer filaments are concentric and have the same pitch and direction.

Alternatively in this or other aspects of the invention, the inner filament is formed of a first material and the outer filaments are formed of a second material having greater load-bearing strength than the first material.

Alternatively in this or other aspects of the invention, the second material is steel.

Alternatively in this or other aspects of the invention, the first material is a polymeric material.

Alternatively in this or other aspects of the invention, the inner filaments are bunched together by at least one restraining loop.

Alternatively in this or other aspects of the invention, the inner filaments are bunched together by an adhesive through at least a portion of the length of the cord.

Alternatively in this or other aspects of the invention, the filaments are free of first-order helical structure.

Alternatively in this or other aspects of the invention, the filaments are bunched together by at least one restraining loop.

Alternatively in this or other aspects of the invention, the filaments are bunched together by an adhesive.

Alternatively in this or other aspects of the invention, the filaments comprise at least one inner filament made of a first material and a plurality of outer filaments made of a second material having greater load-bearing strength than the first material.

Alternatively in this or other aspects of the invention, the jacket at least partially encases the at least one cord.

Alternatively in this or other aspects of the invention, the jacket is made of polyurethane.

Alternatively in this or other aspects of the invention, the coated rope or belt is used in combination with an elevator car.

In another aspect of the invention, a method of forming a coated rope or belt for suspending and/or driving an elevator car is disclosed. The method includes the steps of arranging a plurality of filaments into a cord that is free of second-order helical structure and substantially retaining at least one of said cords in a jacket.

Alternatively in this or other aspects of the invention, the arranging step comprises twisting a plurality of outer filaments around at least one inner filament such that the cord forms a first-order helix.

Alternatively in this or other aspects of the invention, the outer filaments are concentric and have the same pitch and direction.

Alternatively in this or other aspects of the invention, the arranging step comprises bunching the filaments together by at least one restraining loop.

Alternatively in this or other aspects of the invention, the arranging step comprises bunching the filaments together by an adhesive through at least a portion of the length of the cord.

In another aspect of the invention, a cord used in a coated rope or belt suspending and/or driving the elevator car comprises a plurality of filaments that are free of second-order helical structure.

As used in the present application, the term "filament" refers to an elongated threadlike object that cannot be further divided by disentanglement. If the filament is metallic, then the object could also be referred to as a "wire." On the other hand, the term "strand" refers to an elongated threadlike object that can be further divided by disentanglement. For example, a "strand" may include a plurality of entangled "filaments."

Moreover, the term "first-order" used in the present application refers to a helical structure formed by twisting a plurality of non-twisted filaments along a center axis. On the other hand, the term "second-order" refers to a helical structure formed by twisting a plurality of first-order helical structures along a different center axis. The definitions of first- and second-orders of helical structures are consistent with general usage of those terms in the technology field.

Features of the disclosed coated rope or belt and method of making thereof will be described in greater detail below. It will also be noted here and elsewhere that the device or method disclosed herein may be suitably modified to be used in a wide variety of applications by one of ordinary skill in the art without undue experimentation.

BRIEF DESCRIPTION OF THE DRAWINGS

For a more complete understanding of the disclosed device and method, reference should be made to the various exemplary coated rope or belts illustrated in greater detail in the accompanying drawings, wherein.

It should be understood that the drawings are not necessarily to scale and that the disclosed arrangements are sometimes illustrated diagrammatically and in partial views. In certain instances, details which are not necessary for an understanding of the disclosed device or method which render other details difficult to perceive may have been omitted. It should be understood, of course, that this disclosure is not limited to the particular arrangements illustrated herein.

DETAILED DESCRIPTION OF THE DISCLOSURE

Figure 1:
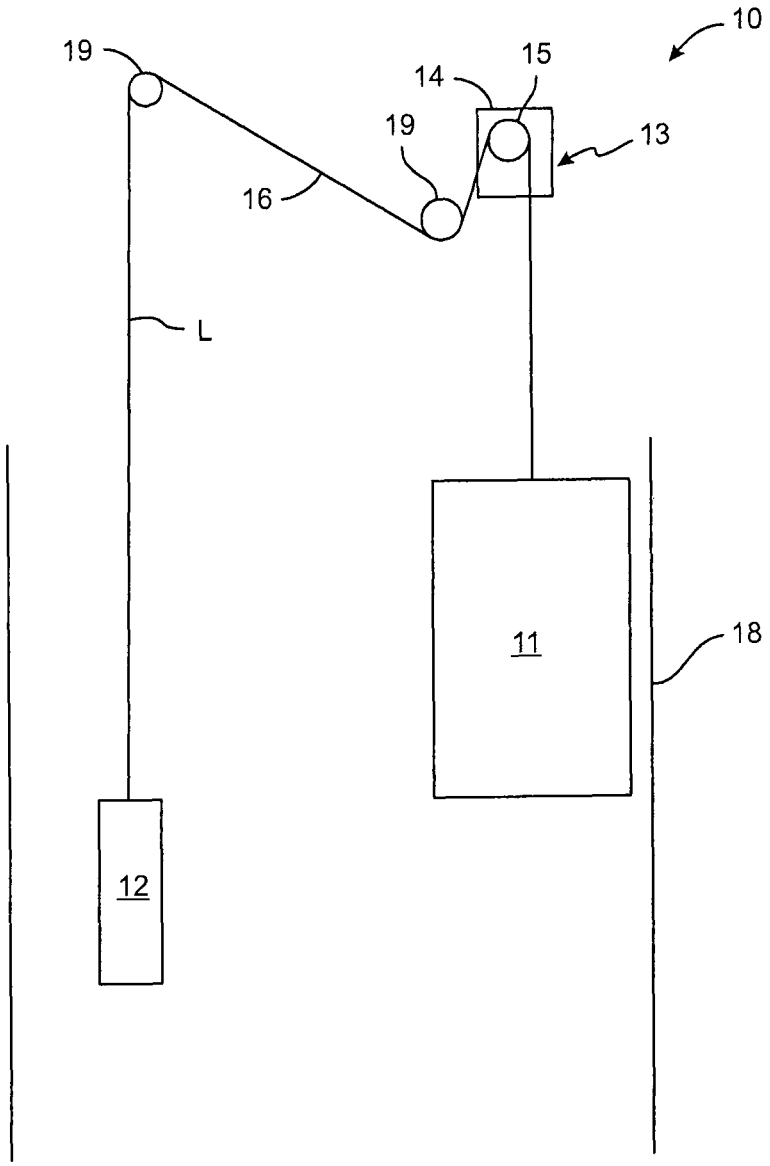
FIGS. 1-3 are side views of various exemplary elevator systems that could use a coated rope or belt according to one aspect of the present disclosure.
Figure 2:
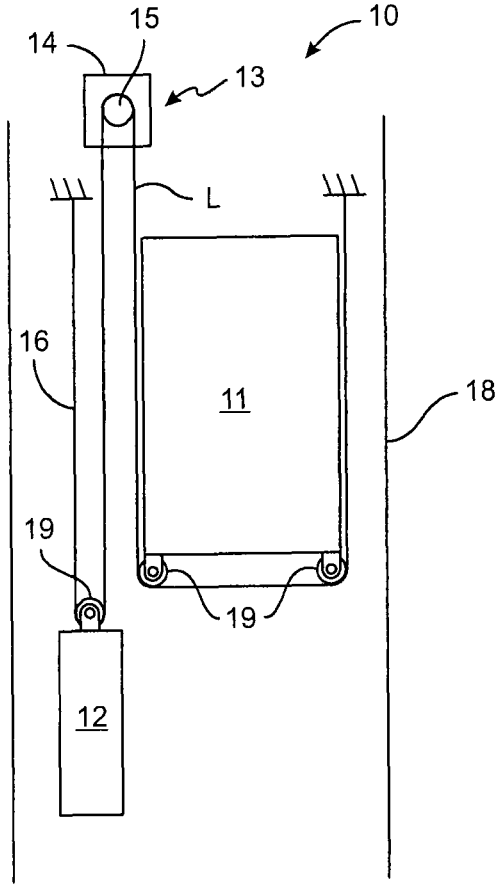
Figure 3:
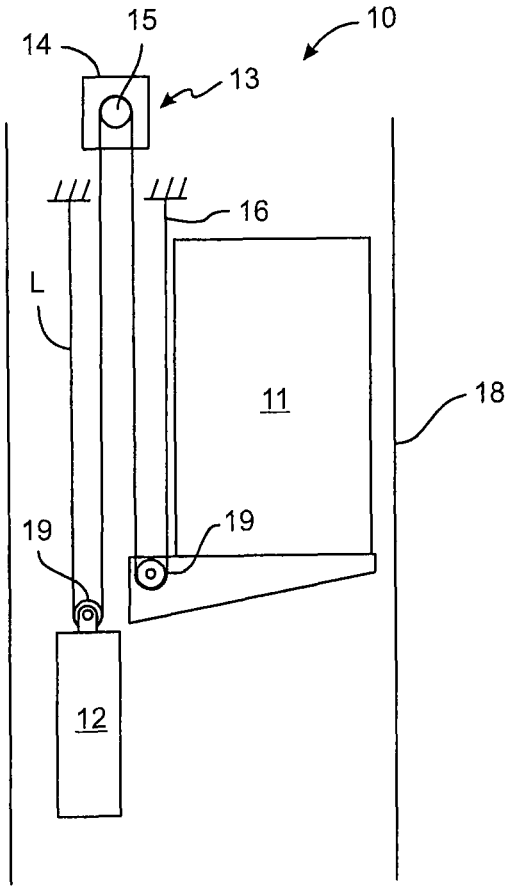

FIGS. 1-3 illustrate various exemplary arrangements of a traction elevator system 10. Features of the elevator system 10 that are not required for an understanding of the present invention (such as the guide rails, safeties, etc.) are not discussed herein. The elevator system 10 can include a car 11 operatively suspended or supported in a hoistway 18 with one or more coated rope or belt 16. The coated rope or belt 16 could also suspend or support a counterweight 12 that helps balance the elevator system 10 and maintain tension on the coated rope or belt 16 on both sides of a traction sheave 15 during operation. The elevator system 10 can also include a traction drive 13 that includes a machine 14 in operative connection with the traction sheave 15. The coated rope or belt 16 is engaged with the sheave 15 (and possibly one or more additional diverter, deflector or idler sheaves 19) such that rotation of the sheave 15 drives, moves or propels the coated rope or belt 16 (through traction), thereby raising or lowering the car 11 and/or counterweight 12. The machine 14 may include an electrical motor and could be gearless or have a geared transmission.

FIG. 1 provides a 1:1 roping arrangement in which the one or more coated rope or belt 16 terminate at the car 11 and counterweight 12. FIGS. 2-3 show that the car 11 and/or the counterweight 12 could have one or more additional sheaves 19 thereon engaging the one or more coated rope or belt 16 and the one or more coated rope or belt 16 can terminate elsewhere, typically at a structure within the hoistway 18 (such as for a machineroomless elevator system) or within the machine room (for elevator systems utilizing a machine room). The number of additional sheaves 19 used in the arrangement determines the specific roping ratio (e.g. the 2:1 ratio shown in FIGS. 2-3 or a different ratio). Furthermore, FIG. 3 provides a so-called rucksack or cantilevered type elevator system. As should now be understood, a variety of elevator systems could utilize the present invention.

Figure 4:
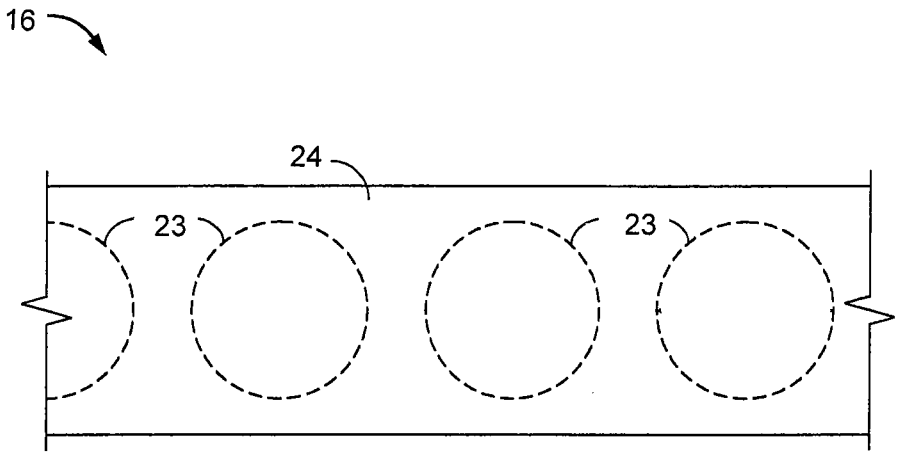
FIG. 4 is a sectional partial side view of an exemplary coated rope or belt.

Turning to FIG. 4, the coated rope or belt 16 may include one or more load-bearing cords 23 at least substantially retained in a jacket 24. A "coated rope" refers to a load-bearing configuration having an aspect ratio (defined as rope width/rope thickness) of about 1, such as a single cord 23 in a jacket 24 (e.g. a round rope in a jacket). A "coated belt" refers to a load-bearing configuration having an aspect ratio (defined as belt width/belt thickness) of greater than 1, such as two or more cords 23 in a jacket 24.

The phrase "substantially retained" means that the jacket 24 has sufficient engagement with the cords 23 such that the cords 23 do not pull out of, detach from, and/or cut through the jacket 24 during the application on the coated rope or belt 16 of a load that can be encountered during use in the elevator system 10. In other words, the cords 23 remain at their original positions relative to the jacket 24 during use in an elevator system 10. The jacket 24 could completely encase/envelop the cords 23 (such as shown in FIG. 4), substantially encase/envelop the cords 23, or at least partially encase/envelop the cords 23.

Each of the cords 23 includes a plurality of filaments 30 that are arranged together in a single step. In one embodiment, at least some of the filaments 30 are formed of metal, such as a carbon steel, with properties which enable the steel to be drawn. A typical steel may have a medium carbon content resulting in drawn strength in the range of between about 1800 and about 3300 MPa. The steel may be cold drawn and/or galvanized for the recognized properties of strength and corrosion resistance of such processes. The jacket 24 may be formed of a polyurethane material or other materials of suitable strength and durability. The jacket 24 may also contain a fire retardant composition.

Figure 5:
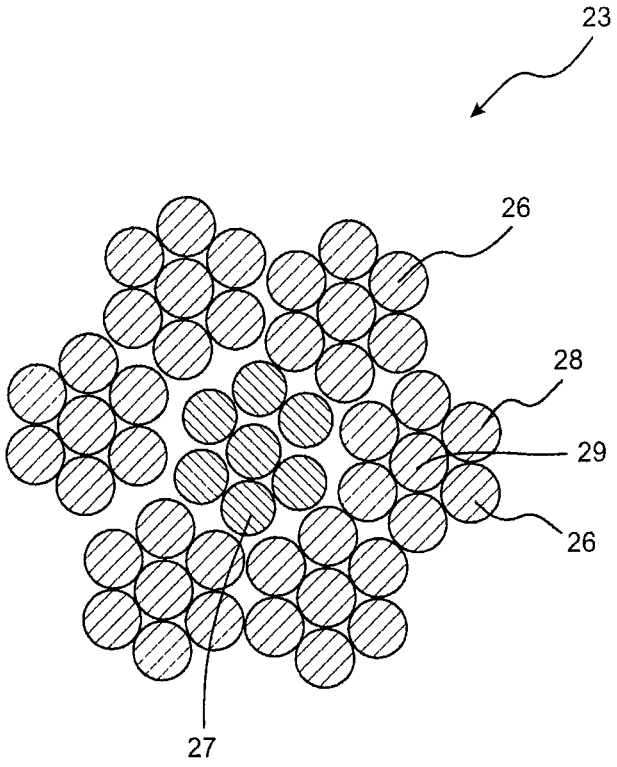
FIG. 5 PRIOR ART
FIG. 5 is an enlarged cross-sectional view of a cord used in a conventional coated rope or belt (prior art)

A conventional cord 23 is illustrated in FIG. 5 as including six outer strands 26 twisted around a center strand 27 in a (1+6) configuration. Each strand 26 also includes six outer filaments 28 twisted around a center filament 29 in a (1+6) configuration. As a result, the cord 23 in FIG. 5 has an overall 7×7 configuration and includes a second-order helical structure.

Figure 6:
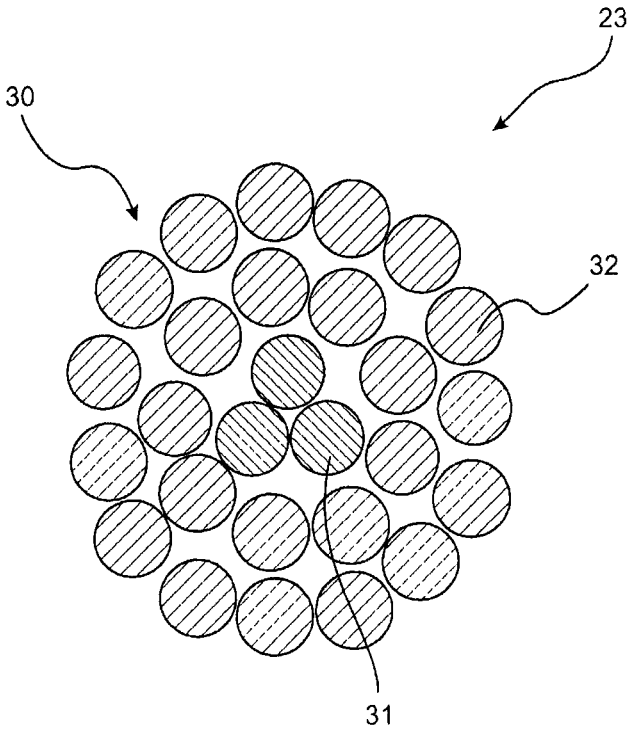
FIG. 6 is an enlarged cross-sectional view of one possible arrangement of a cord that could be used in the coated rope or belt of the present disclosure.

Turning now to FIG. 6, a first possible arrangement of the cord 23 according to the present application is illustrated as extending along the longitudinal length L of the coated rope or belt 16 and including a plurality of filaments 30. As shown in FIG. 4, the filaments 30 may include at least one inner filament 31 and a plurality of outer filaments 32 surrounding the at least one inner filament 31.

In a possible refinement, at least seven outer filaments 32 could be used in the cord 23. In another possible refinement, the inner filament 31 could be made of a first material and the outer filament 32 could be made of a second material having greater loading-bearing strength than the first material. For example, the first material may be a non-metallic material, such as a polymeric material, and the second material may be a metallic material, such as steel. However, it is to be understood that the inner and outer filaments (31, 32) may be formed of the same material, e.g. steel, in other embodiments of the present application.

The outer filaments 32 may form a first-order helical structure through a single twisting step to reduce manufacturing time and cost. To that end, the inner and outer filaments (31, 32) in FIG. 6 are free of second-order helical structure. As discussed above, second-order helical structure requires a first step of twisting non-twisted filaments into a plurality of first-order helical strands, followed by a second step of twisting the first-order helical strands into a second-order helical structure. Moreover, as a result of the single twist step, the first-order outer filaments 32 may have same axis, pitch, and direction. Without wishing to be bound by any particular theory, it is contemplated that such uniformity in the filaments' spatial orientation could minimize the filament-to-filament contact, thereby improving the durability of the cord 23, an advantageous feature heretofore unknown. Finally, the inner filament 31, when formed of a polymeric material, provides a soft cushion for the outer filaments 32, which not only further reduces filament-to-filament contact to improve the durability of the cord 30, but also dampens the cord 30 to reduce noise generated during elevator operation, both features heretofore unknown.

Turning now to FIGS. 7-10, a second possible arrangement of a cord 23 according to the present application is illustrated as extending along the longitudinal length L of the coated rope or belt 16 and including a plurality of non-twisted filaments 30, which may be retained within the jacket 24 of the coated rope or belt 16. The filaments 30 are bunched together, in a single step, at one or more locations along the length L of the cord 23. The filaments 30 in the second embodiment remain non-twisted after the bunching step.

In one possible refinement, the non-twisted filaments 30 could include at least one inner filament 35 and a plurality of outer filaments 36 surrounding the at least one inner filament 35. The inner filament 35 may be made of a first material and the outer filaments 36 may be made of a second material having greater load-bearing strength than the first material. For example, the first material may be a non-metallic material, such as a polymeric material, and the second material may be a metallic material, such as steel. However, it is to be understood that the cord 23 may also include a single type of non-twisted filaments and the use of different materials, such as the soft inner filament, is only optional.

Figure 7:
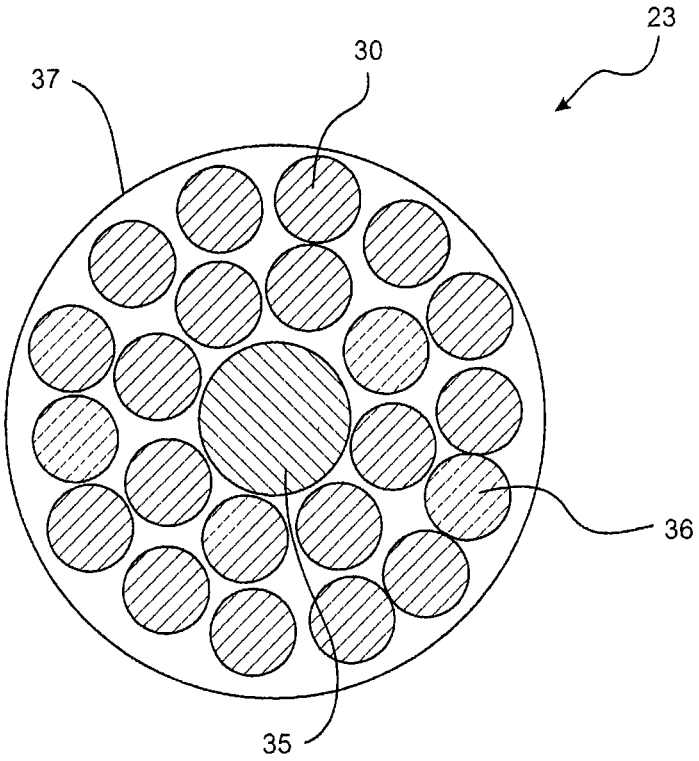
FIG. 7 is an enlarged cross-sectional view of another possible arrangement of a cord that could be used in the coated rope or belt of the present disclosure.
Figure 8:
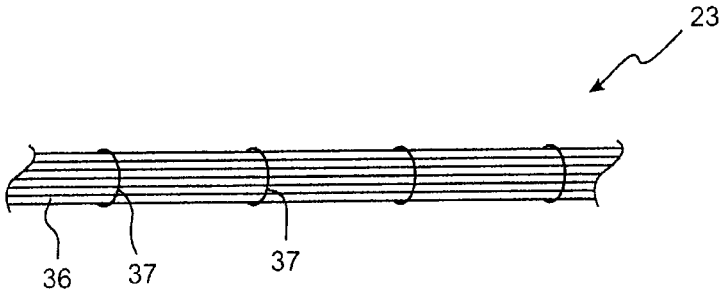
FIG. 8 is a side view of the cord shown in FIG. 7.
Figure 9:
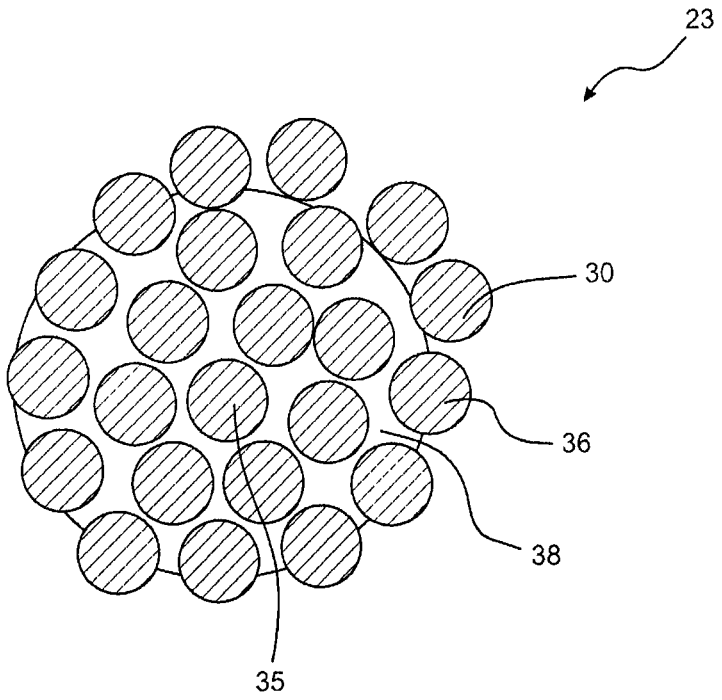
FIG. 9 is an enlarged cross-sectional view of another possible arrangement of a cord that could be used in the coated rope or belt of the present disclosure.
Figure 10:
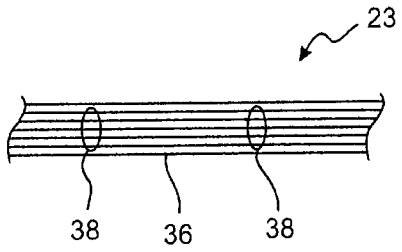
FIG. 10 is a side view of the cord shown in FIG. 9.

As illustrated in FIGS. 7-8, the non-twisted filaments 30 are bunched together by at least one restraining loop 37, which may be a filament, tape, or other suitable bundling mechanisms. On the other hand, the non-twisted filaments 30 may be bunched together by an adhesive 38 applied through at least a portion of the length L of the cord 23, as illustrated in FIG. 9-10.

In the cord 23 shown in FIGS. 7-10, the filaments 30 remain non-twisted after the single bunching step to reduce manufacturing time and cost. As a result, the filaments (30) in this embodiment are free of both first- and second-orders structures. Without wishing to be bound by any particular theory, it is contemplated that such non-twisted spatial orientation would minimize the filament-to-filament contact, thereby improving the durability of the cord 33, an advantageous feature heretofore unknown. Moreover, when the optional inner filament 35 is used, the inner filament 35 may provide a soft cushion for the outer filaments 36, which not only further reduces filament-to-filament contact to improve the durability of the cord 23, but also dampens the cord 23 to reduce noise generated during elevator operation, both features heretofore unknown.

In some alternative arrangements, some or all of the features of the cords 23 discussed above may be combined with each other in forming a hybrid cord 23 in accordance with the present application. For example, the cord may include the first-order helical outer filaments but are further bunched together by the restraining loop and/or the adhesive.

Moreover, the cord 23 may also include a plurality of non-twisted inner filaments bunched together and a plurality of first-order outer filaments surrounding the non-twisted inner filaments. Finally, the cord may include at least one softer inner filament in some arrangements and may include a single type of filament in other arrangements.

Referring back to FIG. 4, one or more the disclosed cords 23 are retained within the jacket 24. The cords 23 may be equal in length and diameter, and may be approximately evenly spaced within the jacket 24. The jacket 24 could be any suitable material, including a single material, multiple materials, two or more layers using the same or dissimilar materials, and/or a film. In one embodiment, the jacket 24 is formed of a polymeric material, such as an elastomeric thermoplastic urethane that is applied to the cord 23 using, for example, an extrusion or a mold wheel process. In another arrangement, the jacket 24 could be a woven fabric that engages and/or integrates the cords 23. Other materials may also be used to make the jacket 24, provided that strength and durability of such materials are sufficient to meet the required functions of the coating layer, including traction, wear, transmission of traction loads to the one or more cords 23 and resistance to environmental factors. As an additional arrangement, the jacket 24 could be one or more of the previously mentioned alternatives in combination.

In some non-limiting arrangements of the present application, the minimum number of filaments used in the cord according to this disclosure is eight, which is determined by the inventors of the present application as capable of accommodating the various features of the disclosed cord while maintaining desirable load-bearing strength. In some embodiments, the maximum number of the filaments used in the cord according to this disclosure could be forty-nine. The filament count in combination with the spatial arrangement of the filaments disclosed herein is not known or contemplated in the technology field of the present application.

Although the jacket in FIG. 4 appears to be flat, the present invention could also be used with coated belts having grooves or ribs, for example "poly-V" belts.

Figure 11:
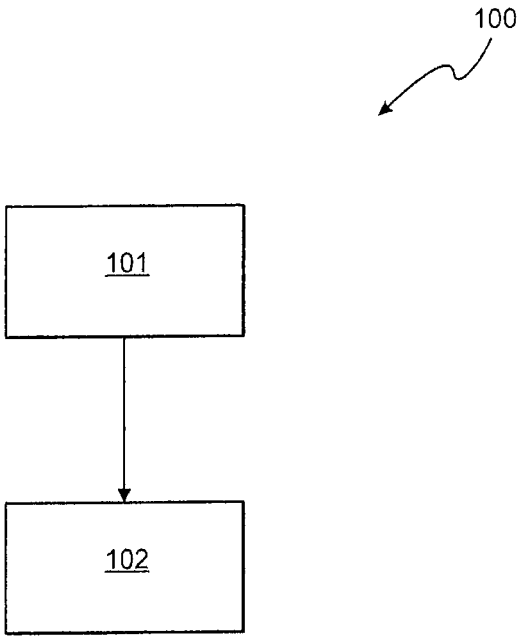
FIG. 11 is a block diagram of a method of making the tension cord in FIGS. 6-10 according to another aspect of the present disclosure.

Referring now to FIG. 11, a method 100 of making the coated rope or belts according to this disclosure is illustrated. The method 100 includes the steps of arranging a plurality of non-twisted filaments into a cord that is free of second-order helical structure (101), and at least substantially retaining at least one of said cords in a jacket (102).

As discussed above, the arranging step may include, in a single step, twisting the outer filaments to form a first-order helical structure. As a result of such a single twisting step, the outer filaments may be concentric and may have the same pitch and direction. The bunching step may also include bunching, in a single step, non-twisted filaments together while maintaining the substantially straight and parallel spatial orientation of the filaments. For example, the non-twisted filaments may be bunched together by at least one restraining loop, which may be a wire, tape, or other suitable bundling mechanisms. On the other hand, the non-twisted filaments may also be bunched together by an adhesive applied through at least a portion of the length of the cord.

The steel filaments used in some embodiments of the present disclosure may be made of mild drawn steel, such as from about 1800 to about 3300 MPa or from about 2300 to about 2700 MPa. The steel filaments may be bunched together using commercially available tubular bunching machines, such as a drum twister or other wire bunchers provided by SKET Verseilmaschinenbau GmbH (http://downloads.german-pavilion.com/downloads/pdf/exhibitor_15629.pdf).

INDUSTRIAL APPLICABILITY

The coated rope or belt and methods of making thereof disclosed herein may have a wide range of industrial, commercial or household applications. The coated rope or belt may be conveniently installed in existing elevator systems without significant modifications thereto. Moreover, as discussed above, the production cost and time may be significantly reduced as a result of the single bunching step while the durability and/or performance of the tension cord may be maintained or even improved over conventional tension members known in the technology field of the present application.

While only certain embodiments have been set forth, alternative embodiments and various modifications will be apparent from the above descriptions to those skilled in the art. These and other alternatives are considered equivalents and within the spirit and scope of this disclosure.

What is claimed is:

1. A belt for suspending and/or driving an elevator car, the belt comprising:

a plurality of cords retained in a jacket to form the belt, the belt having an aspect ratio of width to thickness of greater than one;

at least one cord of the plurality of cords comprising a plurality of filaments that are free of second-order helical structure, wherein the filaments comprise at least one inner filament and a plurality of outer filaments surrounding the at least one inner filament, the outer filaments forming a first-order helical structure wherein the at least one inner filament is free of first-order helical structure;

wherein the at least one inner filament is formed from a polymeric material and the outer filaments are formed from a metallic material having greater load-bearing strength than the polymeric material.

2. The belt of claim 1, wherein the outer filaments are concentric and have the same pitch and direction.

3. The belt of claim 1 wherein the at least one inner filament is made entirely from the polymeric material.

4. The belt of claim 3, wherein the metallic material is steel.

5. The belt of claim 1, wherein the jacket at least partially encases the at least one cord.

6. The belt of claim 5, wherein the jacket is made of polyurethane.

7. The belt of claim 1, in combination with an elevator car.

* * * * *